US011661314B2

(12) United States Patent
Husmann

(10) Patent No.: US 11,661,314 B2
(45) Date of Patent: May 30, 2023

(54) CABLE BRAKE, ELEVATOR CAR AND ELEVATOR SYSTEM

(71) Applicant: Inventio AG, Hergiswil (CH)

(72) Inventor: Josef Husmann, Lucerne (CH)

(73) Assignee: INVENTIO AG, Hergiswil NW (CH)

( * ) Notice: Subject to any disclaimer, the term of this patent is extended or adjusted under 35 U.S.C. 154(b) by 270 days.

(21) Appl. No.: 16/342,231

(22) PCT Filed: Nov. 3, 2017

(86) PCT No.: PCT/EP2017/078116
§ 371 (c)(1),
(2) Date: Apr. 16, 2019

(87) PCT Pub. No.: WO2018/086989
PCT Pub. Date: May 17, 2018

(65) Prior Publication Data

US 2019/0276276 A1 Sep. 12, 2019

(30) Foreign Application Priority Data

Nov. 10, 2016 (EP) ..... 16198242

(51) Int. Cl.
*B66B 5/24* (2006.01)
*B66B 5/18* (2006.01)

(52) U.S. Cl.
CPC ..... *B66B 5/24* (2013.01); *B66B 5/18* (2013.01)

(58) Field of Classification Search
CPC ..... B66B 5/24; B66B 5/185; B66B 5/18; B66B 5/16; B66B 5/044
See application file for complete search history.

(56) References Cited

U.S. PATENT DOCUMENTS 313,451 A * 3/1885 Rogers ..... B66B 5/24 187/407
598,151 A 2/1898 Ilg
(Continued)

FOREIGN PATENT DOCUMENTS

CN 2043615 U 8/1989
CN 1149550 A 5/1997
(Continued)

OTHER PUBLICATIONS

Reuter et al., Cable Brake, English translation of EP 1646575 B1, Nov. 9, 2011. (Year: 2011).*
Li and Zhu, Rope Braking, English translation of CN 202214111 U, May 9, 2012. (Year: 2012).*

*Primary Examiner* — Michael R Mansen
*Assistant Examiner* — Michelle M Lantrip
(74) *Attorney, Agent, or Firm* — William J. Clemens; Shumaker, Loop & Kendrick, LLP

(57) ABSTRACT

A cable brake includes a pair of brake shoes having braking surfaces facing one another and between which a brake cable is guided. A first brake shoe is movable between a braking position, pressing the cable against the braking surface of the other brake shoe, and a release position, releasing the cable between the brake shoes. A releasable retaining device retains the first brake shoe in the release position, and/or a reset device switches the first brake shoe from the braking position to the release position. Two rotatably mounted pivot arms connected to the first brake shoe are arranged in a parallelogram with one side oriented in parallel with the cable guidance direction. A switchable electromagnet of the retaining device holds the first brake shoe in the release position. The brake shoes, pivot arms, retaining device and reset device are arranged in a housing connected to an elevator car.

13 Claims, 5 Drawing Sheets

(56) References Cited

U.S. PATENT DOCUMENTS

| | | | | |
|---|---|---|---|---|
| 2,550,839 | A | 5/1951 | Martin | |
| 3,669,223 | A * | 6/1972 | Arnold | F16G 11/108 188/188 |
| 4,444,293 | A * | 4/1984 | Paul | B66B 5/20 188/250 R |
| 5,228,540 | A * | 7/1993 | Glaser | B66B 5/04 187/355 |
| 6,216,826 | B1 | 4/2001 | Botzet | |
| 7,287,627 | B2 * | 10/2007 | Eckenstein | B66B 5/185 188/137 |
| 8,485,318 | B2 | 7/2013 | Doran | |
| 2005/0006184 | A1 * | 1/2005 | Valjus | B66B 7/021 187/408 |
| 2006/0090969 | A1 | 5/2006 | Eckenstein et al. | |
| 2010/0288587 | A1 | 11/2010 | Doran | |

FOREIGN PATENT DOCUMENTS

| | | | | |
|---|---|---|---|---|
| CN | 1319550 | A | 10/2001 | |
| CN | 1539725 | A | 10/2004 | |
| CN | 202214111 | U | 5/2012 | |
| CN | 103848301 | A | 6/2014 | |
| DE | 112011104744 | T5 * | 12/2013 | B66B 17/00 |
| EP | 0651724 | B1 | 9/1999 | |
| EP | 1205418 | B1 * | 4/2010 | B66B 5/18 |
| EP | 1646575 | B1 | 11/2011 | |
| GB | 236904 | A | 11/1925 | |
| GB | 755094 | A | 8/1956 | |
| GB | 1144818 | A | 3/1969 | |
| KR | 200423194 | Y1 * | 8/2006 | B66B 5/18 |
| KR | 20060087174 | A | 8/2006 | |
| WO | 03002446 | A1 | 1/2003 | |

* cited by examiner

CABLE BRAKE, ELEVATOR CAR AND ELEVATOR SYSTEM

FIELD

The invention relates to a cable brake for an elevator system, to an elevator car comprising a cable brake, and to an elevator system comprising a cable brake.

BACKGROUND

Brakes for braking an elevator car are known in many different forms. From the prior art, for example from WO 03/002446 A1 or EP 0 651 724 B1, cable brakes are known which are rigidly fitted in the elevator shaft and interact with a cable moving together with the elevator car.

Brakes can also be connected to the elevator car or to the counterbalance of an elevator car and can interact with a rail secured in the elevator shaft, as disclosed for example in EP15186504.5 (not yet published), or, acting as a cable brake, with a brake cable immovably attached in the elevator shaft, as disclosed for example in DE 11 2011 104 744 T5 or U.S. Pat. No. 2,550,839.

Cable brakes generally comprise a stationary element and an element movable relative thereto. For example, U.S. Pat. No. 2,550,839 discloses a stationary block having a conical opening, within which two conically tapering wedges are movable, said wedges sliding into the conical opening in the event of braking, thereby coming closer to one another, such that they clamp a cable running between them.

EP 0651724 discloses a cable brake, wherein a movable brake shoe is guided by a spring-loaded cam device. The spring device is held in the open position by a releasable locking device, for example a catch connected to an electrically actuatable solenoid. To guide the movable brake shoe back into the open position, the springs of the spring device are compressed, which is brought about by a piston-cylinder unit. In the event of braking, a portion of the braking force has to be expended to move the piston.

EP 1646575 discloses a cable brake, wherein a brake shoe coupled to a pivotally mounted lever can be moved back and forth between its braking position and its release position by means of a linear drive. The linear drive can be coupled to an electromagnet.

SUMMARY

Therefore, an object of the present invention is to present a cable brake, an elevator car, an elevator system and a method for braking an elevator car that prevent the drawbacks of the known equivalents and enable reliable and easy-to-operate elevator braking, in particular in a compact manner.

The object is achieved by a cable brake for an elevator system, comprising at least one pair of brake shoes having braking surfaces that face one another, the brake cable being able to be guided between the braking surfaces. In the process, the braking surfaces define a cable guidance direction. Since the brake cable generally extends vertically, the cable guidance direction generally corresponds to the vertical when in the fitted state.

The brake cable is designed as a "stationary" cable that is tensioned or fastened in the elevator shaft in the travel direction of the elevator car. A braking force exerted by the cable brake is introduced into the brake cable and transmitted into a building structure by means of the brake cable. For this purpose, the brake cable is preferably fastened in the upper region of the elevator shaft. To prevent the cable swinging, the brake cable is preferably fastened in the lower region of the elevator shaft, for example by means of a fastening clamp, by means of tension springs or a balance weight.

In order to move the braking surface, at least one first brake shoe is movable between a braking position, in which the cable can be pressed against the braking surface of the other brake shoe, and a release position, in which the cable can be released between the brake shoes.

Preferably, one brake shoe is rigidly fitted and one brake shoe is movable relative thereto.

The cable brake preferably comprises a releasable retaining device, which applies a retaining force to the first brake shoe in the release position.

The cable brake comprises a reset device, by which the first brake shoe can be switched from the braking position to the release position. In this context, the braking position should be understood as being a position of the brake in which the first brake shoe begins to clamp the cable between the brake shoes. Advantageously, therefore, the reset device is not designed to return the first brake shoe from the fully tensioned braking position.

At least two rotatably mounted pivot arms are connected to the first brake shoe. The pivot arms are arranged in a parallelogram, one side of which is arranged in parallel with the cable guidance direction.

Preferably, the pivot arms are rotatably hinged at one end to a cable brake housing, and are rotatably connected at the other end to the first brake shoe.

The parallelogram is formed by the pivot arms and the connecting lines of the hinge points, to the housing on the one hand and to the brake shoe on the other. The parallelogram is in a plane that is parallel to the cable guidance direction.

When the pivot arms rotate, the braking surface of the first brake shoe thus remains permanently parallel to the cable guidance direction, and the braking surface thus remains parallel to the other braking surface at the transition point from the release position to the braking position. The braking surfaces are thus brought close together uniformly over their entire surface area. The cable is therefore prevented from becoming jammed or squashed at particular points.

The retaining device comprises a switchable electromagnet that holds the first brake shoe in the release position, in particular when supplied with current.

In the event of braking, the locking can be released very quickly, without the need to mechanically slide a catch, for example. This also prevents a mechanical component from malfunctioning, such as breaking or becoming stuck.

The retaining device and the reset device are separate devices. Therefore, not only can the retaining device be actuated quickly, but it can also be arranged entirely independently of the reset device.

The space requirements are very low. Since no mechanical component needs moving, the retaining device can be arranged in substantially the same plane as the pivot arms forming the parallelogram. The electromagnet can, for example, interact with an armature arranged on one pivot arm. This enables an arrangement that is both compact and planar. This arrangement allows a cable brake to be attached between an elevator car and an elevator shaft.

In particular, the brake shoes each have one braking surface and are preferably designed to brake exactly one cable. For this purpose, they preferably have an extension that is longer in the cable guidance direction than transversely thereto. In particular, the brake shoes comprise braking surfaces of which the shape is adapted to the shape of the cable. Preferably, the braking surfaces have a semi-cylindrical shape and are thus suited to a cable having a round diameter.

In an advantageous design, the pivot arms comprise a spring device which applies a spring force to the first brake shoe in the braking position. In the process, each pivot arm is equipped with at least one brake spring each, for example a disk spring or an assembly of disk springs. The brake spring ensures that the brake shoes are spring-mounted with respect to one another even when there is contact with the cable and the brake shoes are pulled into the braking position by way of friction with the cable. The cable is thus prevented from being squashed.

By way of example, the brake spring is pretensioned between two disks. Preferably, the brake springs are designed as compression brake springs and the braking pressure can be adjusted in each case.

In the release position, the pivot arms are deflected by an angle with respect to a normal to the cable guidance direction, in particular by an angle with respect to the horizontal when in the fitted state.

For the brake shoes to be pulled into the braking position in the event of cable contact, the pivot arms are deflected downwards in the release position, for example when in the fitted state, if the cable brake is fitted to an elevator car and the car is to be prevented from dropping. The pivot arms can also be deflected upwards if upward acceleration is to be prevented.

In one possible design of the brake cable, the first brake cable can be switched into the release position when the reset device is supplied with current. This can be done, for example, by means of a spindle motor or a ram powered by compressed air. Preferably, the reset device comprises a switchable stroke magnet.

The stroke magnet reacts immediately to changes in the current supply. In the event of resetting, the reset device can thus be deactivated again very quickly such that the brake shoes can resume the braking position immediately.

In particular, the reset device is arranged such as to act on one pivot arm. To do so, a stroke magnet can be equipped with a pull rod, for example, which presses on a counterpart on one of the pivot arms.

Once the brake shoe is in the release position, the reset device need no longer be supplied with current since the brake shoe is held in the release position by the retaining device. The reset device can be brought back to a position in which it does not prevent the brake shoe switching from the release position to the braking position. This is necessary to allow the brake shoe to rapidly switch to the braking position.

The reset device can act on a different pivot arm from the retaining device, or it can act on the same pivot arm but from an opposite side. The reset device, retaining device and pivot arms can thus be arranged in substantially one plane, further favoring the planar design of the cable brake.

In an advantageous design, the cable brake has a stop, which is arranged such that in the braking position, in which the cable is fixedly clamped between the brake shoes, at least one pivot arm and/or the first brake shoe abut(s) the stop. The stop thus defines a particular limit position of the pivot arms and/or the first brake shoe, in which position the pivot arms and the first brake shoe are also held in place by the influence of a frictional force exerted by a cable moving relative to the brake shoes. The pivot arms can thus not slide out of the braking position.

Preferably, the hinge points of the pivot arms form a rectangle in the braking position. The pivot arms face in the direction of the normal to the cable guidance direction. In this position, the hinge points to the brake shoes are at the maximum distance from the hinge points to the cable brake housing, and the parallelogram is at its maximum extension. The brake springs can optimally deploy their braking force towards the opposite brake shoe and thus towards the cable. Particularly preferably, the stop is arranged such that the parallelogram approximately assumes a rectangular position in the event of braking.

Preferably, the retaining device and/or the reset device of the cable brake are inactive, in particular de-energized, in the event of braking. If the current supply stops, the cable brake thus switches automatically to the braking position.

In an advantageous design of the cable brake, the retaining device and the reset device are coupled together such that the reset device can be activated, i.e. the first brake shoe can switch into a release position, only when the retaining device is active, i.e. when the retaining apparatus is ready to hold the first brake shoe in a release position. In particular, the cable brake comprises an electrical circuit which ensures that a switchable stroke magnet of the reset device can be supplied with current only when the switchable electromagnet of the retaining device is supplied with current. When the electromagnet is disconnected, the power to the stroke magnet is inevitably also switched off.

This ensures that no power is supplied to the reset device when, for example, a fault is detected during resetting and the switchable electromagnet is disconnected as a result. The brake shoe can then resume the braking position without being obstructed by the reset device.

Advantageously, the cable brake comprises a safety device, in particular a speed limiter, or can be coupled to a safety device, in particular a speed limiter. The safety device is designed to ensure the retaining device releases as soon as a predefinable or predefined speed is exceeded. For this purpose, the electromagnet of the retaining device can be actuated by the safety device.

It may also be provided that, if re-triggering occurs during a reset, the reset device is also released when the electromagnet is interrupted.

The cable brake comprises a housing, in which the brake shoes, the pivot arms, the retaining device and the reset device are arranged. The housing can be connected to an elevator car such that the cable brake preferably interacts with a brake cable rigidly fitted in an elevator shaft. A particularly preferred planar arrangement of the cable brake is ensured if the retaining device and the reset device, as well as possibly the stop, are arranged on a common housing plate to which the pivot arms are also hinged. A stationary brake shoe can also be fitted on the same housing plate.

It is particularly advantageous for a cable brake to be equipped with at least one feed spring that exerts a force on the first brake shoe in the direction of the braking position. The feed spring is preferably rotatably mounted about an axis arranged in parallel with the rotational axes of the pivot arms.

In particular, the feed spring is rotatably hinged at one end to a cable brake housing, and rotatably connected at the other end to the first brake shoe. The feed spring can thus be arranged in substantially the same plane as the pivot arms forming the parallelogram, and does not impair the planar construction of the cable brake. The feed spring ensures that the first brake shoe moves towards the braking position once the retaining device has released. For this purpose, the spring force of the feed spring has a force component in the cable guidance direction.

In particular, a plurality of, preferably four, feed springs arranged in parallel with one another are provided. The force in the direction of the braking position is thus distributed to the feed springs. The spring forces are preferably designed such that if one spring fails, e.g. breaks, the other springs still apply a sufficiently large force to reliably move the brake shoe.

If it is assumed, for example, that even in the event of total failure of one of the fitted springs an actuation force corresponding to 150% of the necessary force is still required, an arrangement of two springs would require each spring to apply at least 150% of the necessary force. The overall result, therefore, is a spring force of at least 300%. In the event of securing using four springs, the required 150% of the necessary force if one spring fails is provided by the remaining three springs. The maximum available actuation force when four springs are provided thus corresponds to only at least 200% of the necessary force. Using a plurality of springs thus allows the maximum actuation force to be reduced, whereby the magnitude of a required retaining force of the retaining device can also be reduced.

The springs may be tension springs. Tension springs are favorable and require no additional guidance.

In an advantageous design, the feed spring is arranged such that, in the release position, it is deflected with respect to a normal to the cable guidance direction by a feed angle and, in the braking position, is deflected by an angle that is smaller than the feed angle. This means that the spring force component in the cable guidance direction is smaller in the braking position than in the release position. The feed springs can thus be switched from the braking position back to the release position in a relatively simple manner, the force required to do so increasing as the angle increases.

In an advantageous design, the cable brake comprises guide rollers for aligning the cable with respect to the brake shoes. The guide rollers are preferably arranged in pairs in the cable guidance direction and are fastened to the cable brake housing.

The guide rollers are necessary particularly when the cable brake is fastened to an elevator car and interacts with a stationary brake cable. While the elevator car is generally guided in the elevator shaft, the brake cable can still have a certain amount of play with respect to the elevator car. The guide rollers ensure that the brake cable is always centered between the brake shoes.

The object is also achieved by means of an elevator car comprising at least one cable brake as described above. For this purpose, the cable brake is in particular rigidly connected to the elevator car.

The cable brake can be integrated in an outer wall of the elevator car. Preferably, however, the cable brake comprises a housing that is connected to a load-bearing structure of the elevator car, for example to the floor of the elevator car. The cable brake is then easily accessible, for example for servicing purposes.

Preferably, an elevator car is equipped with two cable brakes, which interact with stationary brake cables provided on either side of the elevator car.

By way of example, the brake cables, and thus the cable brakes, can be arranged on opposite sides of the elevator car on a center line or line of symmetry of the elevator car, or they can be arranged along a diagonal rotated relative to the center line or line of symmetry of the elevator car. Preferably, the arrangement is such that a guidance force action on the guide rails is minimal. The braking force is thus transmitted to the elevator car uniformly in the event of braking.

Elevator cars can be guided through the elevator shaft along guide cables. Advantageously, the elevator car is equipped with a rail guide. In this case, the rail guide preferably comprises two guide elements. These can be arranged on the side of the elevator car or on a wall of the elevator car; this corresponds to a "piggyback" arrangement.

The object is also achieved by an elevator system comprising a cable brake as described above and/or an elevator car as described above and at least one brake cable, which in particular can be rigidly attached in an elevator shaft. Typically, two brake cables are provided for one elevator car in an elevator shaft.

In an advantageous design, the elevator system comprises hollow rails for guiding the elevator car. The hollow rails can be arranged on opposite shaft walls, or next to one another on one wall for a "piggyback" arrangement.

Since the braking is brought about by means of a brake cable in the event of braking, the system requires brake cables in addition to the rails, but non-reinforced hollow rails can be used to guide the elevator car. Non-reinforced hollow rails are designed to guide the elevator car, but are not sufficiently compression-resistant for braking purposes. They are generally significantly less expensive and easier to fit than reinforced rails.

The object is also achieved by a method for braking an elevator car, in particular as described above, comprising a cable brake, in particular as described above, comprising the following steps. A retaining device is released and at least one first brake shoe switches from a release position to a braking position, upon which two rotatably mounted pivot arms connected to the brake shoe change position. The pivot arms are arranged in a parallelogram, one side of which is parallel to the cable guidance direction. The retaining device is released by interrupting the current supply to an electromagnet.

The clamping electromagnet acts, for example, on a counterpart attached to one of the pivot arms. If no retaining force acts on the pivot arms any longer, the pivot arms change their position, typically on the basis of the spring force of feed springs, which pull the first brake shoe towards the braking position.

If there is contact between the braking surfaces of the brake shoes and the brake cable, the frictional force leads to further closure of the cable brake. A limit position of the brake shoe is reached when the brake shoe, or at least one of the pivot arms, strikes a stop.

Brake springs, for example integrated in the pivot arms, determine the pressure force of the brake shoes on the cable. This force can be adjusted by adjusting the pretension of the brake springs.

By means of the reset device, for example a stroke magnet, the brake shoes can be brought back into a release position. For this purpose, for example, the stroke magnet pushes a brake shoe or a pivot arm back to a tensioned position in which the brake shoe or the pivot arm is held by the electromagnet.

In these designs, a cable brake that interacts with a preferably stationary cable or brake cable is assumed in each case. In this respect, one alternative having the same effect may also be a rail brake that then interacts with a corresponding brake rail, preferably a suitably shaped guide rail. In this case, a rail should be read instead of the cable within the wording of this description and these claims.

DESCRIPTION OF THE DRAWINGS

Preferred embodiments of the invention are described in greater detail in the following description with reference to the accompanying drawings, in which similar elements are denoted by the same reference numerals and in which.

DETAILED DESCRIPTION

Figure 1:
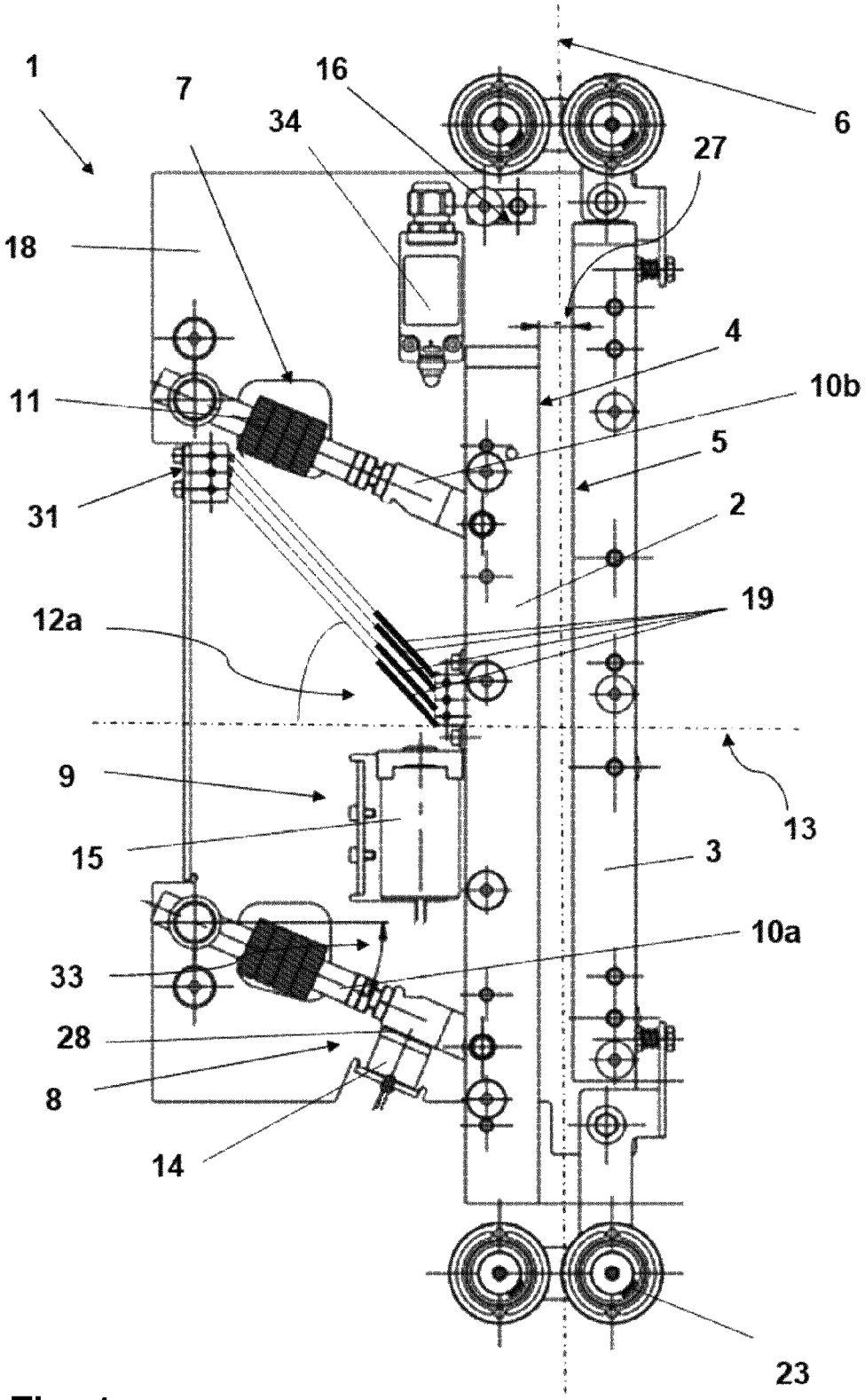
FIG. 1 is a side view of a cable brake in the release position.
Figure 2:
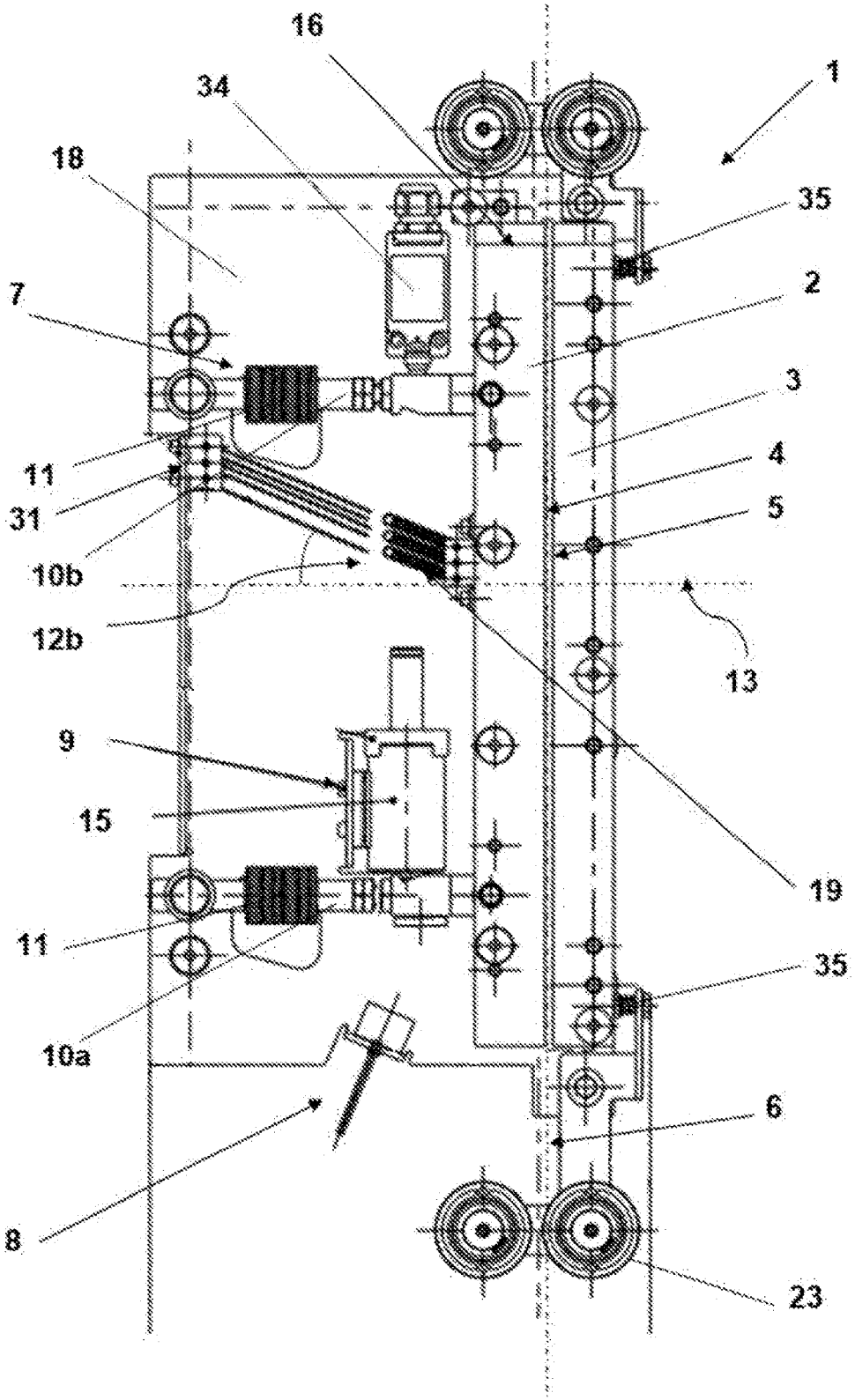
FIG. 2 is a side view of the cable brake in the braking position.
Figure 3:
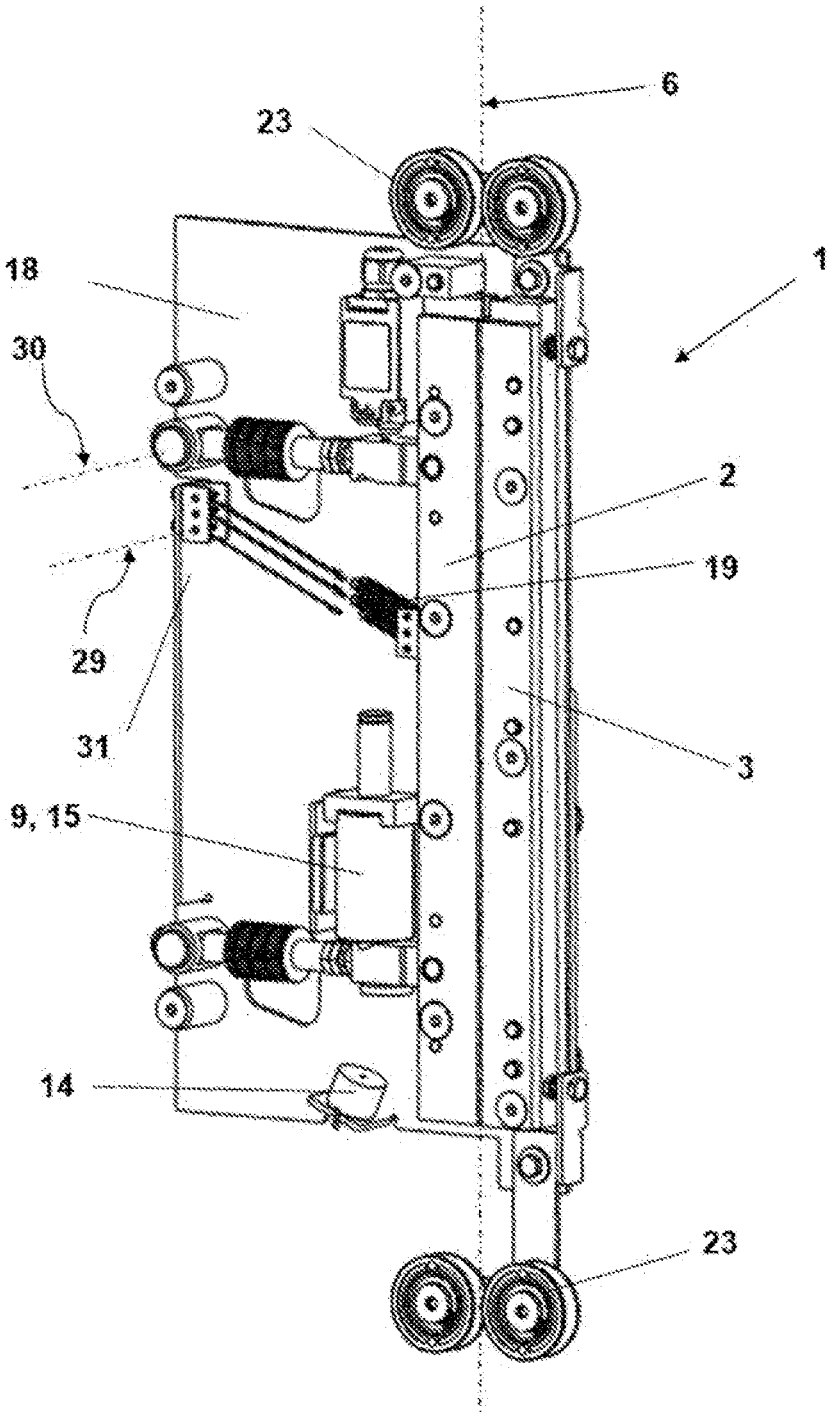
FIG. 3 is a perspective view of the cable brake in the braking position.

FIG. 1 is a side view of a cable brake 1 in the release position. FIGS. 2 and 3 show the same cable brake 1 in the braking position.

The cable brake 1 comprises two brake shoes 2, 3 having braking surfaces 4, 5 that face one another. The brake cable 24 (not shown explicitly in FIG. 1-3; see FIGS. 4*a*, 4*b*, 5*a* and 5*b*) can be guided between the braking surfaces 4, 5 in a cable guidance direction 6.

A first brake shoe 2 is connected to two rotatably mounted pivot arms 10*a*, 10*b*, which are arranged in a parallelogram of which one side, for example the connecting line of the hinge points to the brake shoe 2, is oriented in parallel with the cable guidance direction 6.

By means of the pivot arms 10*a*, 10*b*, the first brake shoe 2 can be moved between a braking position, in which the cable is pressed against the braking surface 5 of the other brake shoe 3 (FIG. 2 and FIG. 3), and a release position (FIG. 1), in which there is a sufficiently large distance 27 between the braking surfaces 4, 5 to release the cable.

The cable brake 1 has a releasable retaining device 8, which applies a retaining force to the first brake shoe 2 in the release position. The retaining device 8 comprises a switchable electromagnet 14, which holds the first brake shoe 2 in the release position when supplied with current.

The electromagnet 14 interacts with an armature 28, which is attached to one of the pivot arms 10*a* and holds the pivot arms 10*a*, 10*b* in a deflection angle 33 with respect to a normal 13 to the cable guidance direction 6. As soon as the electromagnet 14 is de-energized, the retaining force is no longer applied and the pivot arms 10*a*, 10*b* can change their position. In the braking position, the hinge points of the pivot arms 10*a*, 10*b* approximately form a rectangle.

The position change is caused by, for example four, feed springs 19 arranged in parallel with one another. They provide a force in the direction of the braking position. The feed springs 19 are preferably rotatably mounted about an axis 29 arranged in parallel with the rotational axes 30 (FIG. 3) of the pivot arms 10*a*, 10*b*.

The feed springs 19 are deflected in the release position with respect to the normal 13 to the cable guidance direction 6 (with respect to the horizontal when in the fitted state) by a feed angle 12*a*, and are deflected in the braking position by an angle 12*b* that is smaller than the feed angle 12*a*. The closure force component of the feed springs 19 is thus smaller in the braking position, in which the frictional force of the cable is active anyway, than in the release position.

By means of a reset device 9, the first brake shoe 2 can be switched from the braking position to the release position. By way of example, the reset device 9 comprises a switchable stroke magnet 15 arranged in particular so as to act on one pivot arm 10*a*.

Preferably, the electromagnet 14 and the stroke magnet 15 are wired such as to be de-energized in the event of braking.

In addition, the electromagnet 14 and the stroke magnet 15 are coupled such that the stroke magnet 15 is only supplied with current when the electromagnet 14 is supplied with current.

The pivot arms 10*a*, 10*b* comprise a spring device 7, which applies a spring force to the first brake shoe 2 in the braking position. For this purpose, each pivot arm 10*a*, 10*b* is equipped with at least one brake spring 11 each, for example a pretensionable compression spring, in particular a disk spring or an assembly of disk springs.

The cable brake 1 has a stop 16 arranged such that at least the first brake shoe 2 abuts the stop 16 in the braking position.

The cable brake 1 can comprise a position sensor 34, by means of which it can be detected whether the cable brake 1 is in the braking position. If use of the cable brake is detected by means of the position sensor 34, normal travel of the elevator can be prevented in this case. The position sensor 34 can be designed as a switch that is actuated when a pivot arm 10*b* strikes the position sensor 34 in the braking position.

The cable brake 1 preferably comprises a housing plate 18, which forms a housing 17 together with a cover (not shown in the figure; see FIGS. 4*a*, 4*b*, 5*a* and 5*b*). The pivot arms 10*a*, 10*b* are hinged to the housing plate, and a brake shoe 3, the retaining device 8, and the reset device 9 are rigidly fitted thereto. In addition, guide rollers 23 for aligning the cable with respect to the brake shoes 2, 3 are attached to the housing plate 18. In the example, the guide rollers 23 are resiliently coupled to the brake shoe 3 by means of spring devices 35 such that the guide rollers 23 can retreat when the brake cable presses against the brake shoe 3.

A mount 31 for securing the feed springs 19 is also provided on the housing plate 18.

Figure 4A:
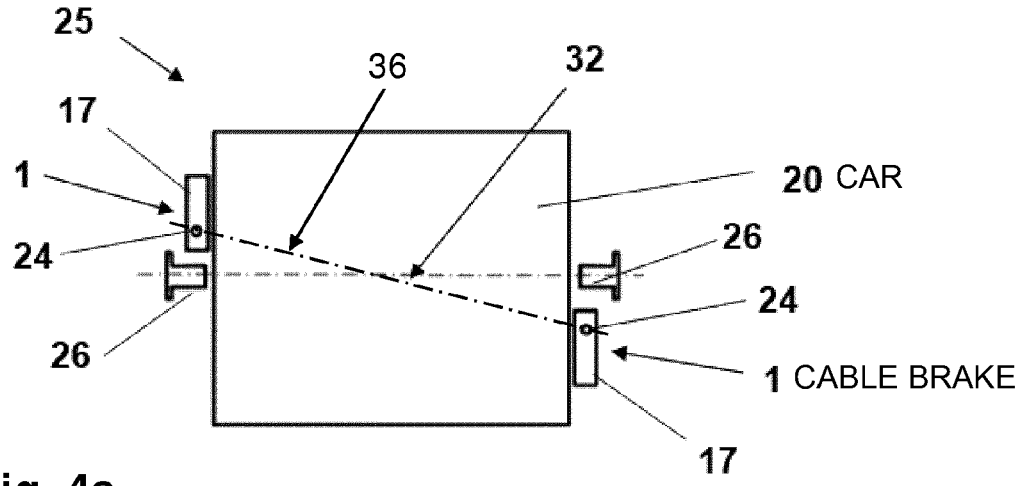
FIG. 4*a* is a schematic plan view of a first example elevator system.
Figure 4B:
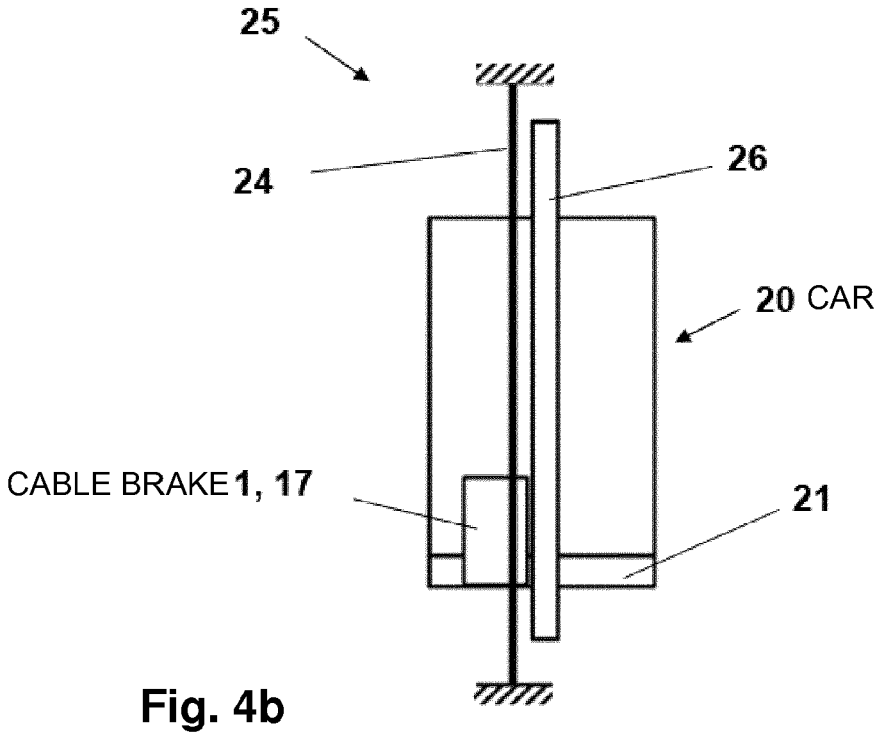
FIG. 4*b* is a schematic side view of the first example elevator system.

FIG. 4*a* is a schematic plan view of a first example elevator system 25, and FIG. 4*b* is a schematic side view of the same example elevator system 25.

In an elevator shaft (not shown in more detail), two hollow rails 26 are provided, which are attached to two opposite walls. The hollow rails are used to guide an elevator car 20.

The brake cables 24 are arranged along a diagonal 36 rotated relative to the center line or line of symmetry of the elevator car 32. Accordingly, cable brakes 1 are attached to the elevator car 20. By means of this arrangement, when the elevator car is being braked a guidance force action on the guide rails 26 is minimal.

The cable brakes 1 each comprise a housing 17, which is fastened to a load-bearing structure of the elevator car 20, such as the floor 21 or a supporting frame.

Figure 5A:
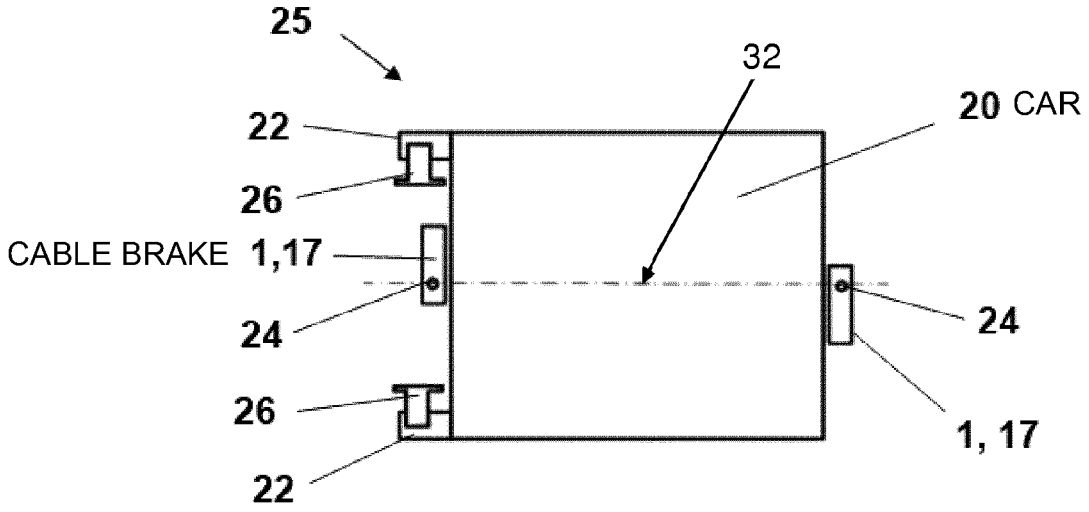
FIG. 5*a* is a schematic plan view of a second example elevator system.
Figure 5B:
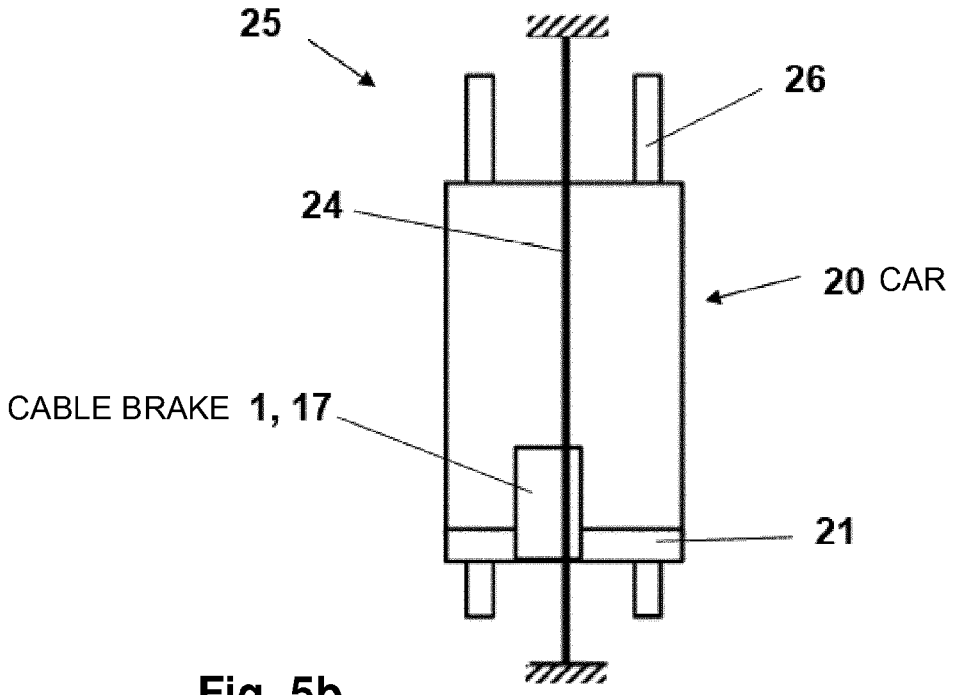
FIG. 5*b* is a schematic side view of the second example elevator system.

FIG. 5*a* is a schematic plan view of a second example elevator system 25, and FIG. 5*b* is a schematic side view of the same example elevator system 25.

In an elevator shaft (not shown in more detail), two hollow rails 26 are provided, which are attached to a wall. The hollow rails 26 are used to guide an elevator car 20, and interact with rail guides 22 attached to the elevator car 20.

The brake cables 24 are arranged on opposite sides of the elevator car 20 on the center line or line of symmetry 32 of the elevator car 20. Accordingly, cable brakes 1 are attached to the elevator car 20. The cable brakes 1 comprise a housing 17, which is fastened to either the floor 21 or a load-bearing structure of the elevator car 20.

The cable brake 1 has a very planar design, and so it has space next to an elevator car 20 even in a narrow elevator shaft.

Typically, the cable brake 1 can be used for brake cables 24 having diameters between 11 and 19 mm. A pair of cable brakes can secure transport loads between 1000 and 2000 kg.

The installation depth is merely approximately four times the cable diameter and crucially is determined by the components used, for example by the diameter of the brake springs 11 or of the electromagnet 15. For example, an installation depth of approximately 50 mm is conceivable for an installation height of more than 500 mm.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system including a cable brake and a brake cable, the cable brake having a pair of brake shoes with braking surfaces that face one another, the brake cable being fastened in an elevator shaft and being guided between the braking surfaces, a first of the brake shoes being movable between a braking position, in which the brake cable is pressed against the braking surface of a second of the brake shoes, and a release position, in which the brake cable is released between the brake shoes, the cable brake comprising:

two rotatably mounted pivot arms each connected to the first brake shoe and being arranged as a parallelogram, one side of the parallelogram being oriented in parallel with a cable guidance direction of the brake cable;

a releasable retaining device that applies a retaining force to the first brake shoe in the release position wherein the retaining force acts on one of the pivot arms;

a reset device for switching the first brake shoe from the braking position to the release position;

a housing in which the brake shoes, the pivot arms, the retaining device and the reset device are arranged, the housing being connected to an elevator car;

wherein the elevator car is guided by hollow rails that are not compression-resistant enough to withstand elevator car braking forces;

wherein at least one of the retaining device and the reset device is inactive during braking of the elevator when the brake shoes are in the braking position; and including at least two feed springs arranged in parallel that exert a force on the first brake shoe in a direction of the braking position, the feed springs being tension springs mounted rotatably about an axis arranged in parallel with rotational axes of the pivot arms.

2. The elevator system according to claim 1 wherein the brake shoes, the pivot arms, the retaining device and the reset device are arranged on a common housing plate in the housing.

3. The elevator system according to claim 1 wherein the retaining device includes a switchable electromagnet that holds the first brake shoe in the release position when the electromagnet is supplied with current.

4. The elevator system according to claim 1 wherein the first brake shoe is switched into the release position when the reset device is supplied with current.

5. The elevator system according to claim 1 wherein the reset device includes a switchable stroke magnet arranged to act on one of the pivot arms.

6. The elevator system according to claim 1 wherein the cable brake includes a stop arranged such that at least one of pivot arms abuts and/or the first brake shoe abuts the stop in the braking position.

7. The elevator system according to claim 1 wherein the retaining device and the reset device are coupled together such that the reset device can be activated only when the retaining device is active.

8. The elevator system according to claim 1 wherein the cable brake includes four of the feed springs arranged in parallel.

9. The elevator system according to claim 1 wherein the feed springs are arranged such that, in the release position, they are deflected with respect to a normal to the cable guidance direction at a feed angle and, in the braking position, they are deflected at an angle that is smaller than the feed angle.

10. The elevator system according to claim 1 wherein the cable brake includes an upper pair of guide rollers and a lower pair of guide rollers that align the brake cable with respect to the brake shoes.

11. A method for braking an elevator car using the elevator system according to claim 1, comprising the following steps:

releasing the retaining device;

moving the first brake shoe from the release position to the braking position whereby the pivot arms change position; and wherein the retaining device is released by interrupting a current supply to an electromagnet holding the first brake shoe in the release position.

12. The elevator system according to claim 1 wherein the reset device acts on the one of the pivot arms acted upon by the retaining device or acts on another of the pivot arms.

13. An elevator system including a cable brake and a brake cable, the cable brake having a pair of brake shoes with braking surfaces that face one another, the brake cable being fastened in an elevator shaft and being guided between the braking surfaces, a first of the brake shoes being movable between a braking position, in which the brake cable is pressed against the braking surface of a second of the brake shoes, and a release position, in which the brake cable is released between the brake shoes, the cable brake comprising:

a releasable retaining device that applies a retaining force to the first brake shoe in the release position;

two rotatably mounted pivot arms each connected to the first brake shoe and being arranged as a parallelogram, one side of the parallelogram being oriented in parallel with a cable guidance direction of the brake cable;

a reset device for switching the first brake shoe from the braking position to the release position wherein the reset device presses on one of the pivot arms;

a housing in which the brake shoes, the pivot arms, the retaining device and the reset device are arranged, the housing being connected to an elevator car;

wherein the elevator car is guided by hollow rails that are not compression-resistant enough to withstand elevator car braking forces;

wherein at least one of the retaining device and the reset device is inactive during braking of the elevator when the brake shoes are in the braking position; and including at least two feed springs arranged in parallel that exert a force on the first brake shoe in a direction of the braking position, the feed springs being tension springs mounted rotatably about an axis arranged in parallel with rotational axes of the pivot arms.

* * * * *